US006878407B2

(12) United States Patent
Park

(10) Patent No.: US 6,878,407 B2
(45) Date of Patent: Apr. 12, 2005

(54) SUEDE-LIKE FABRIC

(76) Inventor: Sang-Ho Park, Chung-Gu APT. 5-907, #284, Ha-gye-Dong, Nowon-Gu, Seoul 139-230 (KR)

( * ) Notice: Subject to any disclaimer, the term of this patent is extended or adjusted under 35 U.S.C. 154(b) by 218 days.

(21) Appl. No.: 10/164,995

(22) Filed: Jun. 7, 2002

(65) Prior Publication Data

US 2002/0194680 A1 Dec. 26, 2002

(30) Foreign Application Priority Data

Jun. 25, 2001 (KR) ..... 2001-36147

(51) Int. Cl.[7] ..... B05D 1/02

(52) U.S. Cl. ..... 427/346; 359/365; 359/366; 359/368; 359/370; 359/372.2; 8/115.51; 428/85; 428/94; 428/96; 428/151; 442/101; 442/102

(58) Field of Search ..... 8/115.51; 427/346, 427/359, 365, 366, 368, 370, 372.2; 428/85, 91, 96, 151, 904; 442/101, 102, 154

(56) References Cited

U.S. PATENT DOCUMENTS 4,448,831 A * 5/1984 Civardi ..... 428/91

* cited by examiner

*Primary Examiner*—Arti R. Singh
(74) *Attorney, Agent, or Firm*—Lee, Hong, Degerman, Kang & Schmadeka

(57) ABSTRACT

The suede-like fabric according to the invention is produced by the process which comprises the steps of supplying aqueous chemical composed of acrylic resin, emulsifying agent and water to treating rollers through chemical coating means; passing the raw fabric cloths between the treating rollers having the chemical supplied and supporting rollers to produce a uniform chemical coating of 70~200 g/m2, the rollers pressing and fixing the passing raw fabric cloths; de-watering and drying the raw fabric cloths having the chemical coating fixed under pressing in a thermal chamber maintained at a temperature between 80 and 200° C.; and heating and pressing the dried raw fabric cloths by means of heating rollers at a temperature between 130 and 150° C. to finish the acrylic coating through this ironing step; and a further step of rubbing-off the coated surfaces of the raw fabric cloths for abrasion by rotating a striker drum made of wood for a predetermined period. The suede-like fabric according to the invention offers the advantage of reducing the effort and expense for maintenance of products and can provide, in spite of a new product, a comfortable and fashionable atmosphere of a long-used old leather due to the appearance of the fabric surface so as to produce a unique optical effect which is not felt from ordinary leather products (FIG. 4).

4 Claims, 3 Drawing Sheets

SUEDE-LIKE FABRIC

FIELD OF THE INVENTION

The present invention relates to a suede-like fabric and a method for producing the same.

BACKGROUND OF THE INVENTION

Generally, the natural leather has been used widely in various industries including cloths, bags, footwear etc. and the consumer demand is on the rise as well.

However, the leather products made from the natural leather are associated with some defects in that they are not only high-priced but also require much effort and expense in laundry and maintenance. Therefore, in recent years, the demand for the raw cloth of the synthetic leather as the substitute for the natural counterpart is tending upward in fact.

Presently the synthetic leather used in place of the natural leather excels the latter in easiness in laundry, improvement in dying fastness, resistance to bacteria, safety, extension in service life through wear resistance, elasticity and tactile sensation.

Nevertheless, consumers are looking for the synthetic leather with much improved quality and a variety of touches along with ever-changing fashion trend in addition to the improved living level.

SUMMARY OF THE INVENTION

The object of the present invention intended to meet the desire of the consumers as described above is to provide a raw cloth which has the optical effect similar to that of a leather worn out after a long use, not felt in the ordinary leather products, by causing the coated layer on the surface of the raw fabric to be abraded to a desired extent through the operation wherein an ordinary fabric, coated on its one face, with an acrylic chemical is subjected to rubbing in a striker drum made of wood.

In a desirable aspect of the invention, the suede-like fabric according to the invention achieving the above object is provided by the process in which a raw fabric cloth passes through a treating roll comprising a mesh or grid roller or embossed-surface roller to apply, on its one side, an aqueous chemical composed of acrylic resin, emulsifying agent and water to the coated amount of 70~200 g/m2 so as to be absorbed and fixed, dried in a thermal chamber at a temperature of 80~200° C., heated and pressed in a heating roller at a temperature of 130~150° C. to result in a coated raw fabric cloth and subsequently the surfaces of coated raw fabric cloths are subjected to a rubbing or friction operation in a striker drum.

Preferably, the above object is also achieved by a method for manufacturing a suede-like fabric according to the invention, which comprises the steps of supplying aqueous chemical composed of acrylic resin, emulsifying agent and water to treating rollers through chemical coating means; passing the raw fabric cloths between the treating rollers having the chemical supplied and supporting rollers to produce a uniform chemical coating of 70~200 g/m2, the rollers pressing and fixing the passing raw fabric cloths; de-watering and drying the raw fabric cloths having the chemical coating fixed under pressing in a thermal chamber maintained at a temperature between 80 and 200° C.; and heating and pressing the dried raw fabric cloths by means of heating rollers at a temperature between 130 and 150° C. to finish the acrylic coating through this ironing step; and optionally a further step of rubbing the coated surfaces of the raw fabric cloths for abrasion by rotating a striker drum made of wood for a predetermined period, preferably for 2 to 6 hours, said drum containing the acryl-coated raw fabric cloths introduced.

In addition, in said step of rubbing, preferably the raw fabric cloths are each wound into a roll such that the back surface of the raw fabric cloth is exposed, fixed each at several positions by stitch-needling to prevent the roll from unwinding, placed each in a sack with the size matching that of the wound raw fabric cloth or roll, and bound, before the raw fabric cloths are introduced in the striker drum.

DETAILED DESCRIPTION OF THE INVENTION

A preferred embodiment of the present invention is described in detailed below by referring to the accompanying drawings.

By the way, the raw fabric cloth usable for the suede-like fabric according to the invention includes any ordinary fabrics or textiles, such as the woven stuffs, file fabrics, cut file fabrics and the like, made of cotton fiber or the synthetic fiber like polyester fiber and the like.

Figure 1:
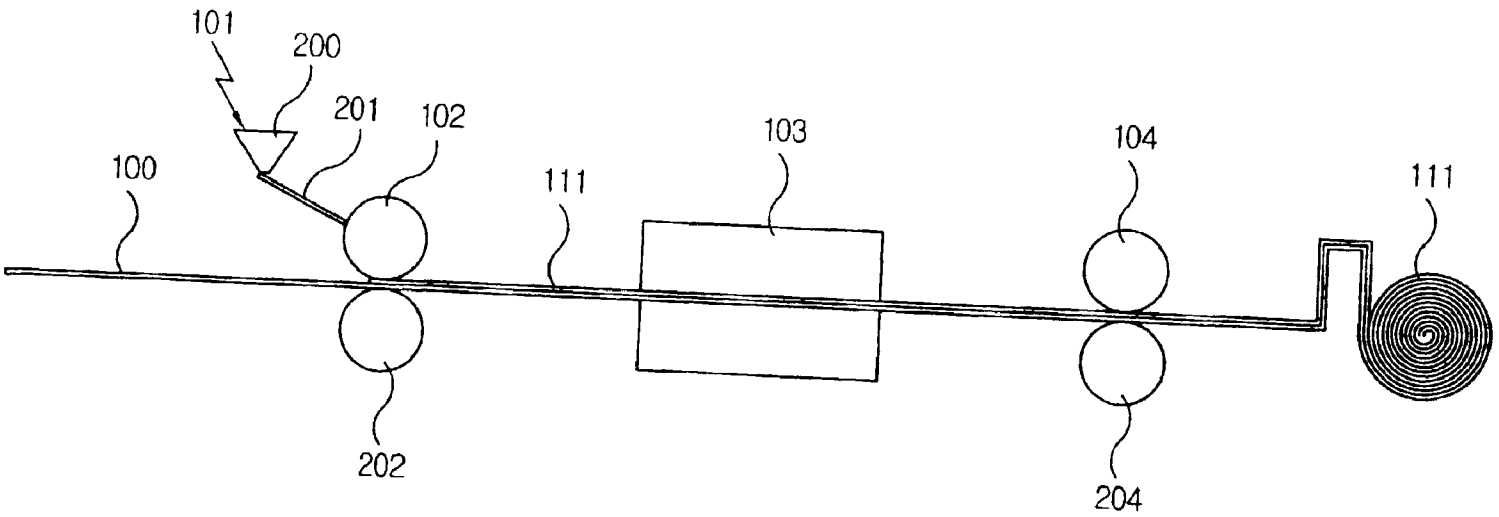
FIG. 1 shows the schematic process of an embodiment illustrating the method for manufacturing the suede-like fabric according to the present invention.
Figure 2:
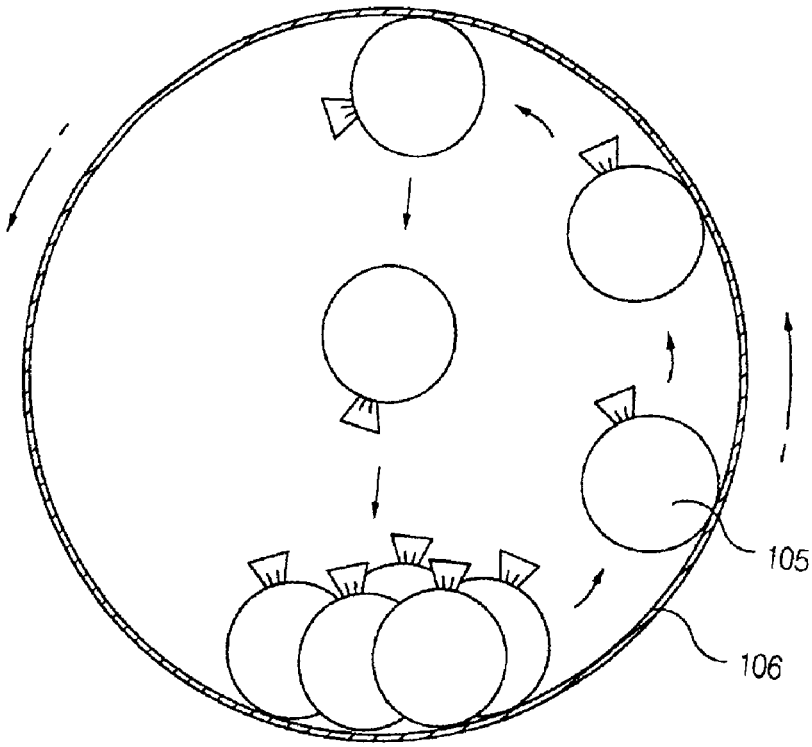
FIG. 2 shows the plan view schematically illustrating the rubbing step in the process for manufacturing the suede-like fabric according to the present invention.

In the manufacturing process, referring to FIG. 1, first an aqueous chemical composed of an acrylic resin, emulsifying agent and water is prepared and the preparation is supplied to a mesh roller 102 as the treating roller through a chemical coating means 101. While a mesh roller 102 is shown in FIG. 1, an ordinary irregular-surfaced or embossed roller may be naturally used as the case may be. The chemical agent coating means 101 comprises a chemical agent container 200 and a chemical agent support 201. The chemical agent discharged from the chemical agent container 200 flows down on the surface of the chemical agent support 201 to enter the mesh roller 102.

The aqueous chemical usable for this purpose is preferably a mixture of acrylic resin and water at the mixing ration of about 4:6, which was found to be most appropriate for the acrylic coating for the production of the suede-like fabric according to the invention.

The chemical agent flowing into the mesh roller 102 through the chemical agent coating means 101 is adjusted at a constant value in dispensing amount by a knife means, not shown, positioned at the end part of the chemical agent supporting base 201. In particular, the amount of the chemical agent for coating varies depending on the kind and thickness of the raw fabric cloths; the dispensing amount is controlled such that lesser amount may be coated for thin cloths and more amount may be coated for thicker cloths.

The chemical agent controlled to be constant in amount as described above is rotated together with the mesh roller 102, with the chemical agent contained in the grooves formed in the mesh roller 102, and handed over to the raw fabric cloth passing between the mesh roller 102 and the supporting roller 202 to be absorbed in the raw fabric.

In other words, the raw fabric cloth 100, as it passes between the mesh roller 102 and the supporting roller 202 made of rubber material, absorbs the chemical agent at a uniform rate between about 70 g/m2 and 200 g/m2 depending on the thickness of the raw fabric cloth 100 and at the same time the chemical agent is fixed on the surface of the raw fabric cloth 100 by the pressing force from the mesh roller 102 and the supporting roller 202.

The raw fabric cloth 111 which has been coated and fixed with the coating chemical agent by the pressing force from the mesh roller 102 is dried in the thermal chamber 103 at a temperature of 80 to 200° C., whereby about 90% of water is removed. When the temperature lies below the lower limit of 80° C., the required drying time would be too long, and conversely at a temperature exceeding the upper limit of 200° C., an excessive drying would take place to give off all the chemical agent component within a short time, leading to burning of the raw fabric cloth in cases. Accordingly, keeping the drying temperature within the range from 80° C. to 200° C. is essential.

In the next step, the raw fabric sheet 111 so dried is caused to pass through the gap between the heating roller 104 kept at a temperature of 130 to 150° C. and the supporting roller 204 of rubber for heating and pressing again. Due to this ironing step with the thermal roller 104, the moisture of 10% remaining the raw fabric sheet 111 is completely dried up and simultaneously an acrylic coating with a good gloss is finished on the surface of the fabric cloth.

The supporting rollers 202 and 204 positioned respectively below the mesh roller 102 and the heating roller 104 should desirably be made of elastic material including rubber, so that these lower rollers can support the raw fabric cloth elastically when it is pressed down by the upper rollers 102 and 104.

Thereafter, the raw fabric cloths 111 acryl-coated as described above, usually in the form of wound rolls in packing sacks, are put in a striker drum 106 made of wood and subjected to rotation for 2 to 6 hours so as to partially erase the acryl coating layer 110 on the raw fabric cloths 111 through the action of inter-contacting or rubbing.

As the striker drums 106 usable in the rubbing step of the present manufacturing process, the same striker drums of wooden barrels as those used for handling the leather in leather plants, having the diameter of about 3 meters, may be used. That is, the striker drum 106 may desirably be made of wooden material rather than of iron, though the iron drums are sometimes used, so that minor generation of friction heat can be expected for utilization in appropriately abrading the acryl coating 110 on the surface of raw fabrics from the use of general fabrics instead of the leather.

Figure 3:
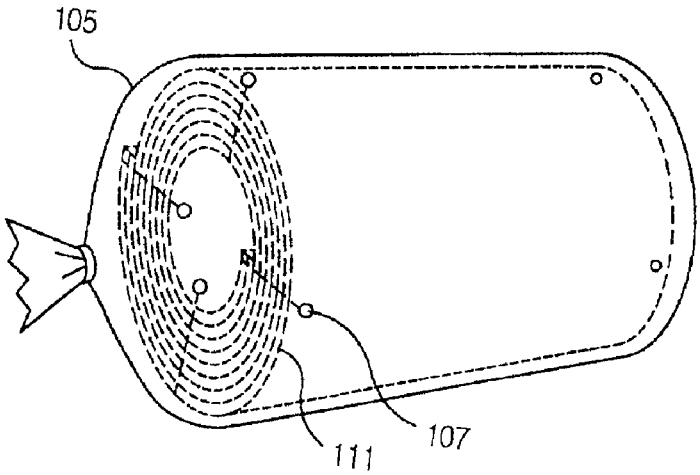
FIG. 3 shows the enlarged perspective view illustrating wound raw fabric cloths in rubbing operation in a striker drum as shown in FIG. 2

Regarding the friction step in the above-described manufacturing process, as mentioned earlier, there is needed an additional sub-step before the introduction of the acryl-coated fabric cloths into a striker drum 106 in order to prevent the raw fabric cloths 111 from getting entangled inside of the drum. This step comprises, as shown in FIG. 3, winding the sheets of raw fabric cloths 111 each as long as 20 to 50 meters into the form of rolls, stitch needling 107 the rolls at various locations, putting the raw fabric rolls 111 in the respective sacks 105 each having the size adapted for a wound raw fabric cloth 111 and then binding the sacks to close the raw fabric cloths.

It is to noted that the raw fabric cloths should be wound, with the back surface of the raw fabric cloths exposed, so that the windings of the raw fabric cloths positioned outermost following the winding step, which windings tend to be subjected to most violent frictions, may not undergo excessive abrasion through frictional contact to thereby keep these outermost raw fabric windings valuable or usable also as the product.

Figure 4:
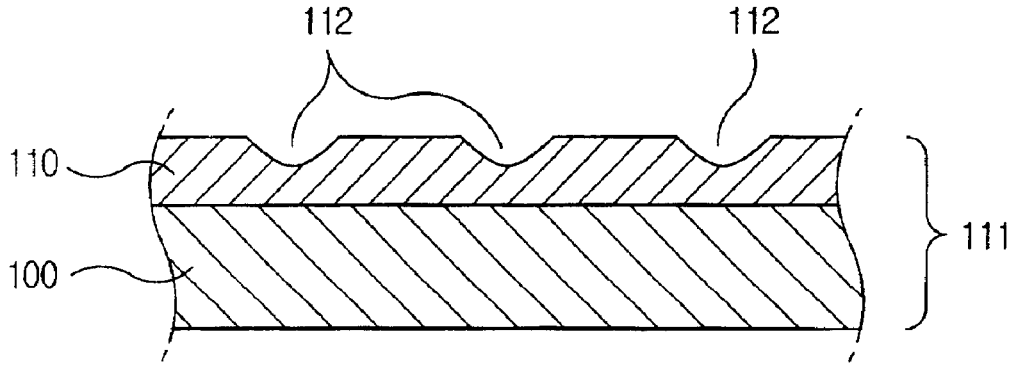
FIG. 4 shows the cross section of a finished suede-like fabric according to the present invention.

A plural number of sacks 105 containing raw fabric cloths 111 wound and stitch-needled as described above are collectively put in the striker drum 106 before rotating the drum. When the striker drum 106 starts to rotate, some sacks 105 would move up along with the rotating drum 106 before falling and some sacks 105 would collide to each other. Thus, the neighboring raw fabric windings would be brought into frictional contact with each other under the shaking impact condition and cause the acryl coatings on the raw fabric windings to be stripped off partially to result in the finished suede-like fabric cloths formed with intermittent worn-out parts, exhibiting a unique atmosphere as if aged enough, as shown in FIG. 4.

Whereas the thickness of the acryl coatings formed on the surface of the raw fabric cloths and the thickness to remove through friction vary depending on the thickness of the raw fabric cloths and the supplying amount of the chemical agent for coating, the friction time within the striker drum 106 ranges from about 2 to 6 hours.

In the manufacturing process of a suede-like fabric according to the invention, specially the use of the chemical agent including acrylic coating material and the striking drum is important, wherein the drying temperature and period in the thermal chamber 103, as well as the period of the frictional operation in the striker drum 106 are influenced by the coated amount of the chemical agent.

The suede-like fabrics according to the invention may be usefully applied in clothing, bags, footwear, and the like, where any general synthetic leather can be applied.

A preferred working example is described below to help understand the invention without limiting the invention.

WORKING EXAMPLE

First, a mixed raw fabric consisting of 32% polyester fiber/62% cotton fiber was weaved by using 140D polyester yarn and 7'S cotton yarn as the warp and weft yarn respectively and the woven green fabric was subjected to weight reduction and peach processing and finally a raw fabric cloth based on the cotton-blend was prepared through the processing steps including refining, bleaching, dying and the like in a conventional manner.

On the other hand, an aqueous chemical agent consisting of 39 wt. % of acrylic resin, 5 wt. % of emulsifier and 56 wt. % of water was made ready (in this example, LAB-3025, Sam Sung Chemical Co. was used), and contained in a chemical agent container, so that the chemical agent may flow along the chemical agent supporting base at a constant rate to a mesh roller.

The raw fabric cloth of cotton blend in preparation as described above was caused to pass between the mesh roller into which the above-described chemical flowed and a supporting roller under a roller pressure, so that the above-described chemical agent (LAB-3025) could be coated and fixed on the surface of the raw fabric cloth at a uniform rate of 100 g/m2.

The raw fabric cloth having the chemical fixed by the pressed rollers was dried in a thermal chamber at 100° C. to remove approximately 90% of the moisture.

The dried raw fabric cloth was caused to pass between a heating roller at 140° C. and the mating supporting roller. The rest 10% of water remaining in the raw fabric cloth was completely removed through the heat and pressure processing, whereby the acrylic coating was perfected and the surface of the coated raw fabric sheet exhibited a remarked gloss.

As shown in FIG. 3, the raw fabric cloth was cut into partial sheets each having the length of 20 to 50 meters to wind around reels, wherein the rolls of fabric windings were stitch-needled at proper locations to prevent unwinding. Then, the raw fabric rolls were placed in respective sacks each adapted for the dimensions of the raw fabric roll and the sacks were bound.

Several sacks containing raw fabric rolls were placed in a lump into a wooden striking drum and subjected to rotation for three hours. Thus, the neighboring raw fabric windings were brought into frictional contact with each other under the shaking impact condition and caused the acryl coatings on one of the contacting surfaces to be partially stripped off the raw fabric windings to produce the finished suede-like fabric cloths formed with intermittent worn-out parts, exhibiting a unique atmosphere as if the fabrics were aged enough.

As seen in the above, the suede-like fabric according to the invention is a leather product which is washable by water so as to be laundered with ease at general homes and in addition, can satisfy the consumer desire due to the low cost for maintenance and tendency. Specially, the inventive suede-like fabric in line with the recent fashion trend can effect, in spite of a new product, a comfortable atmosphere of a long-used old leather from the appearance of the fabric surface so as to produce a unique optical effect which is not felt from ordinary leather products.

It is to be understood that, while the invention was described mainly with respect to a specific embodiment, the invention is never restricted to that embodiment and a variety of modifications and alterations would be possible to a man skilled in the art by referring to the description or drawings presented here and within the spirit of the invention and thus those modifications or alterations are to fall within the scope of the invention, which scope should be limited only by the attached claim.

What is claimed is:

1. A suede-like fabric produced by coating an aqueous chemical comprising arylic resin on a raw fabric cloth at the coating rate of 70 to 200 g/m2, wherein the suede-like fabric is produced by the process in which while a raw fabric cloth passes through treating rolls, an aqueous chemical further including emulsifying agent and water is applied on one surface of the raw fabric cloth and then is absorbed and fixed before being dried in a thermal chamber at a temperature of 80 to 200° C., and the dried raw fabric cloth is heated and pressed in a thermal roller at a temperature of 130 to 150° C. to result in a coated fabric cloth and subsequently the surfaces of coated fabric cloths are partially abraded through a rubbing operation in a striker drum.

2. The suede-like fabric of claim 1, wherein a method for manufacturing the suede-like fabric comprises:

supplying aqueous chemical comprising acrylic resin, emulsifying agent and water to a treating roller through a chemical applying means;

passing the raw fabric cloth between the treating roller having the chemical supplied and a supporting roller to produce a uniform chemical coating of 70 to 200 g/m2, the rollers pressing and fixing the passing raw fabric cloth;

drying the raw fabric cloth having the chemical coating fixed under pressing in a thermal chamber maintained at a temperature between 80 and 200° C.; and passing the dried raw fabric cloth between the heating roller at a temperature between 130 and 150° C. and a supporting roller for heating and pressing the treated raw fabric cloth to thereby finish the acrylic coating through this ironing.

3. The method according to claim 2, wherein a further step of rubbing the coated surfaces of the raw fabric cloths is included after the ironing step in a striker drum made of wood for abrasion.

4. The method according to claim 3, wherein in the step of rubbing, the raw fabric cloths are each wound into a roll such that the back surface of the raw fabric cloth is exposed, and fixed each at several positions by stitch-needling to prevent the roll from unwinding, before being introduced into the striker drum.

* * * * *